US010907275B2

(12) United States Patent
Chun et al.

(10) Patent No.: US 10,907,275 B2
(45) Date of Patent: Feb. 2, 2021

(54) ELECTRO-SPINNING APPARATUS

(71) Applicant: MAK Co., Ltd., Hwaseong-si (KR)

(72) Inventors: Byung Joon Chun, Suwon-si (KR); Jin Sam Kim, Osan-si (KR)

(73) Assignee: MAK CO., LTD., Hwaseong-si (KR)

( * ) Notice: Subject to any disclaimer, the term of this patent is extended or adjusted under 35 U.S.C. 154(b) by 0 days.

(21) Appl. No.: 16/391,905

(22) Filed: Apr. 23, 2019

(65) Prior Publication Data

US 2020/0208301 A1 Jul. 2, 2020

(30) Foreign Application Priority Data

Dec. 28, 2018 (KR) ..... 10-2018-0172411

(51) Int. Cl.
*D01D 5/00* (2006.01)

(52) U.S. Cl.
CPC ..... *D01D 5/0069* (2013.01)

(58) Field of Classification Search
CPC ..... D01D 5/0069; D01D 4/06; D01D 5/0061
See application file for complete search history.

(56) References Cited

U.S. PATENT DOCUMENTS

2005/0224998 A1* 10/2005 Andrady ..... D01D 5/0092 264/10
2010/0112020 A1* 5/2010 Westbroek ..... D01D 5/0061 424/401
2012/0088003 A1* 4/2012 Seo ..... D01D 5/0069 425/376.1
2013/0040140 A1* 2/2013 Joo ..... D01D 5/14 428/401
2013/0328225 A1* 12/2013 Marshall ..... D01D 5/08 264/12
2014/0048982 A1* 2/2014 Dee ..... D01D 5/0069 264/465
2014/0353882 A1* 12/2014 Joo ..... D01D 5/0069 264/465
2016/0047067 A1* 2/2016 Park ..... D01D 5/0061 264/466
2017/0260652 A1* 9/2017 Kinoshita ..... B29C 48/142

* cited by examiner

*Primary Examiner* — Nahida Sultana
(74) *Attorney, Agent, or Firm* — Cantor Colburn LLP

(57) ABSTRACT

Provided is an electro-spinning apparatus, which can perform spinning uniformly over the entire width of a manufactured fiber. The apparatus includes: a solution distribution unit made of an electrical conductor to distribute and supply a spinning solution to injection lines; spinning nozzles installed to be individually coupled to the injection lines and spinning while adjusting a spinning amount of the spinning solution supplied through the injection lines; a solution supply line installed to be coupled on the top of the solution distribution unit to supply the spinning solution heated to a high temperature to the solution distribution unit; a high voltage supply unit installed on one side of the solution distribution unit to supply high voltage power; and a hot air supply unit for supplying air of hot temperature to each of the spinning nozzles and injecting the hot air through the spinning nozzles together with the spinning solution.

5 Claims, 7 Drawing Sheets

ELECTRO-SPINNING APPARATUS

BACKGROUND OF THE INVENTION

Field of the Invention

The present invention relates to an electro-spinning apparatus, and more specifically, to an electro-spinning apparatus, which can perform spinning uniformly with respect to the entire width of a manufactured fiber as the spinning nozzles are individually controlled, and is easy to maintain.

Background of the Related Art

Electro-spinning is a technique of manufacturing a fiber of a fine-diameter by spinning a fiber material solution in a charged state, and recently, as the electro-spinning is used as a technique for manufacturing nanometer class fibers, studies on the technique are actively progressed. The diameter of a fiber manufactured by the electro-spinning has a thickness of micrometers to nanometers, and if the thickness decreases like this, totally new features appear. For example, the new features include increase in the ratio of the surface area to the volume, improvement in surface functionality, improvement in mechanical properties including tension, and the like.

Due to the superior features, nano-fibers may be used in many important application fields. For example, a web configured of nano-fibers is a separation membrane type material having a porous property and may be applied in various fields such as various types of filters, moisture-permeable and waterproof fabrics, dressing for treating injuries, artificial scaffolds, and the like.

Accordingly, techniques of various electro-spinning nozzle packs and the like are proposed in Korean Laid-opened Patent No. 10-2014-0038762 and the like. However, since a conventional electro-spinning nozzle like this has a structure of simultaneously spinning gases and solutions and has a very complicated structure of applying high voltage power together with a spinning solution, there is a problem in that the efficiency is lowered, and the spinning solution cannot be spun uniformly.

SUMMARY OF THE INVENTION

An object of the present invention is to provide an electro-spinning apparatus, which can perform spinning uniformly with respect to the entire width of a manufactured fiber as the spinning nozzles are individually controlled, and is easy to maintain.

To accomplish the above object, according to an aspect of the present invention, there is provided an electro-spinning apparatus including: a solution distribution unit made of an electrical conductor to distribute and supply a spinning solution to a plurality of injection lines; a plurality of spinning nozzles installed to be individually coupled to the plurality of injection lines and spinning while adjusting a spinning amount of the spinning solution supplied through the injection lines; a solution supply line installed to be coupled on the top of the solution distribution unit to supply the spinning solution heated to a high temperature to the solution distribution unit; a high voltage supply unit installed on one side of the solution distribution unit to supply high voltage power; and a hot air supply unit for supplying air of hot temperature to each of the plurality of spinning nozzles and injecting the hot air through the spinning nozzles together with the spinning solution.

In addition, the solution distribution unit preferably includes: a lower distribution plate having the plurality of injection lines formed at regular intervals; a top cover plate installed to be coupled on the top surface of the lower distribution plate to form a predetermined enclosed space; and an intermediate distribution plate installed to be interposed in the enclosed space to uniformly distribute and move the spinning solution supplied to the enclosed space toward the injection lines.

In addition, in the present invention, the spinning nozzle preferably includes: a nozzle body detachably coupled on the side surface of the lower distribution plate and having a spinning hole formed to spin the spinning solution toward the bottom; a spinning adjustment valve installed on the top of the nozzle body to adjust the opening degree of the spinning hole; and a hot air injection hole installed on the bottom of the nozzle body to guide hot air supplied by the hot air supply unit to the spinning hole to inject the hot air toward the bottom together with the spinning solution.

In addition, in the present invention, a line heating unit for heating the solution supply line is preferably further provided in the solution supply line.

In addition, in the present invention, a distribution unit heating unit for heating the solution distribution unit is preferably further provided in the solution distribution unit.

In addition, in the present invention, the spinning adjustment valve preferably includes: a valve rod installed to pass through the nozzle body in the vertical direction, the lower end of which is inserted into the upper end of the spinning hole; an elastic unit for pressing the valve rod toward the top using an elastic force; and an adjustment knob installed on the top of the nozzle body to finely move the valve rod in the vertical direction by rotating the valve rod.

DESCRIPTION OF SYMBOLS

Figure 1:
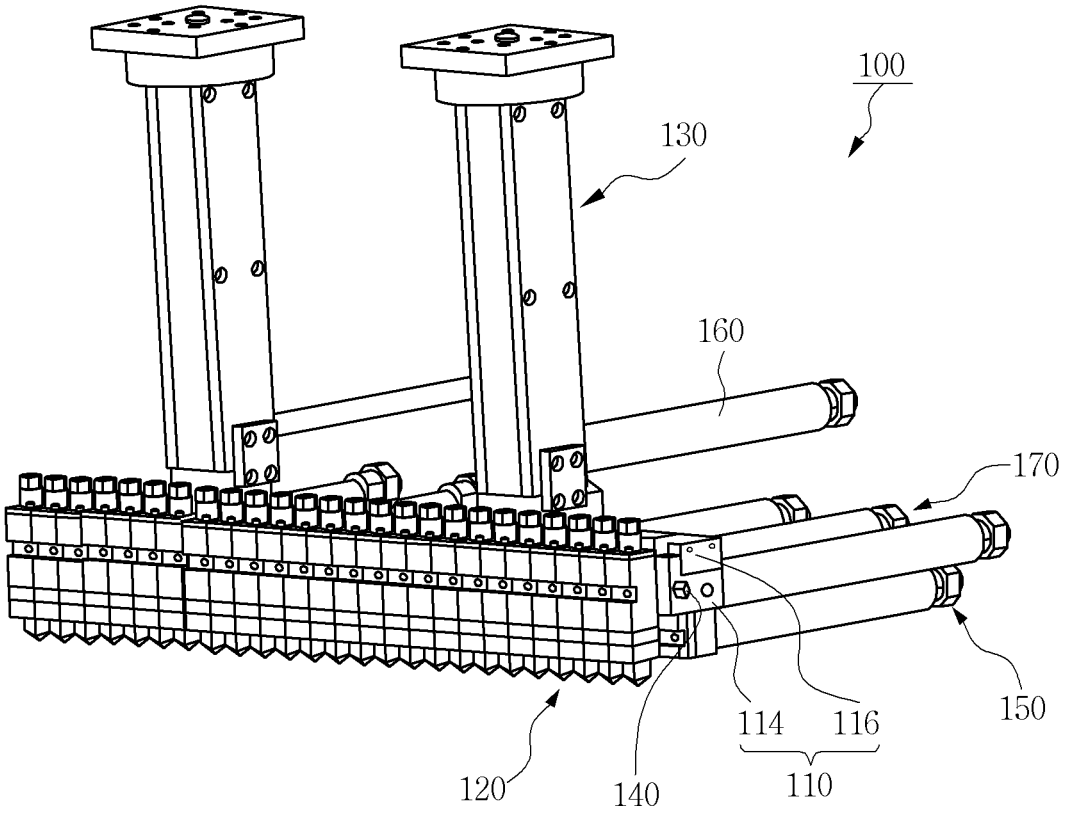
FIG. 1 is a perspective view showing the structure of an electro-spinning apparatus according to an embodiment of the present invention.

100: Electro-spinning apparatus according to an embodiment of the present invention

110: Solution distribution unit 120: Spinning nozzle

130: Solution supply line 140: High voltage supply unit

150: Hot air supply unit 160: Line heating unit
170: Distribution unit heating unit

DETAILED DESCRIPTION OF THE PREFERRED EMBODIMENT

Hereinafter, a specific embodiment of the present invention will be described with reference to the attached drawings.

As shown in FIG. 1, an electro-spinning apparatus 100 according to this embodiment may be configured to include a solution distribution unit 110, a spinning nozzle 120, a solution supply line 130, a high voltage supply unit 140, and a hot air supply unit 150.

First, the solution distribution unit 110 is a component made of an electrical conductor overall to distribute and supply a spinning solution to a plurality of injection lines 112. That is, the solution distribution unit 110 is installed between the solution supply line 130 and the spinning nozzle 120 to distribute the spinning solution supplied from the solution supply line 130 to a plurality of spinning nozzles 120 and is made of an electrical conductor overall to be charged with high voltage applied by the high voltage supply unit 140.

Figure 3:
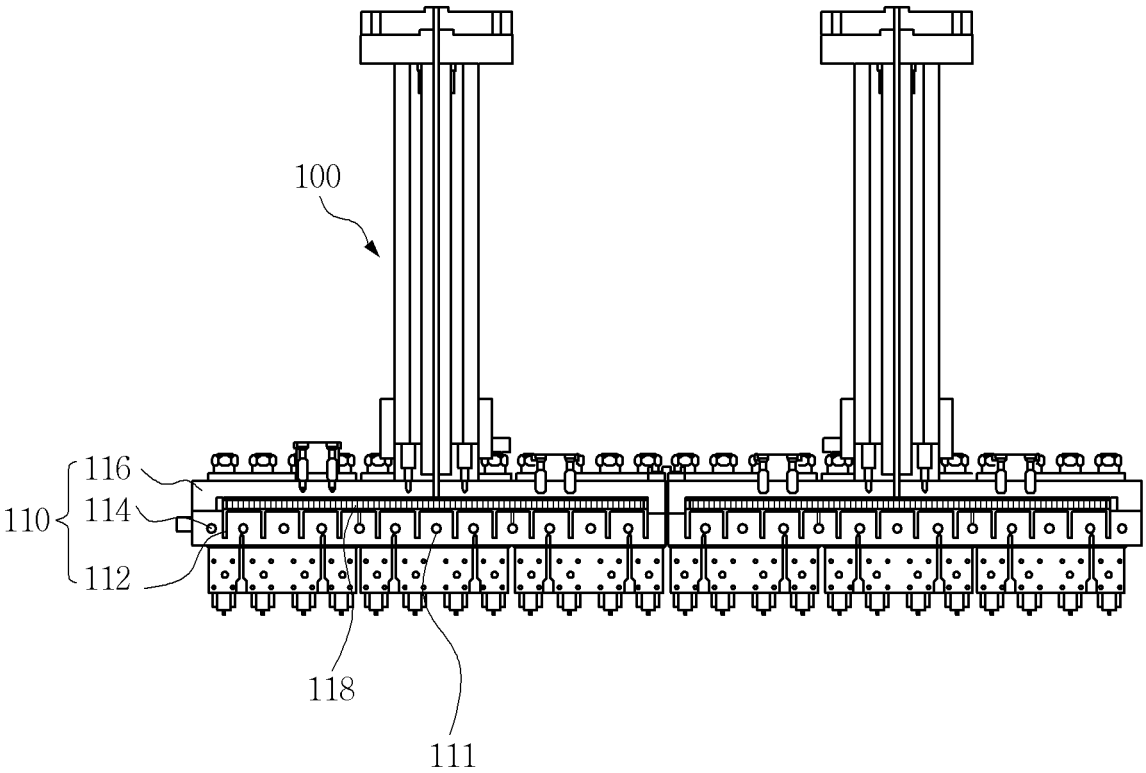
FIG. 3 is a traverse sectional view showing the structure of an electro-spinning apparatus according to an embodiment of the present invention.
Figure 7:
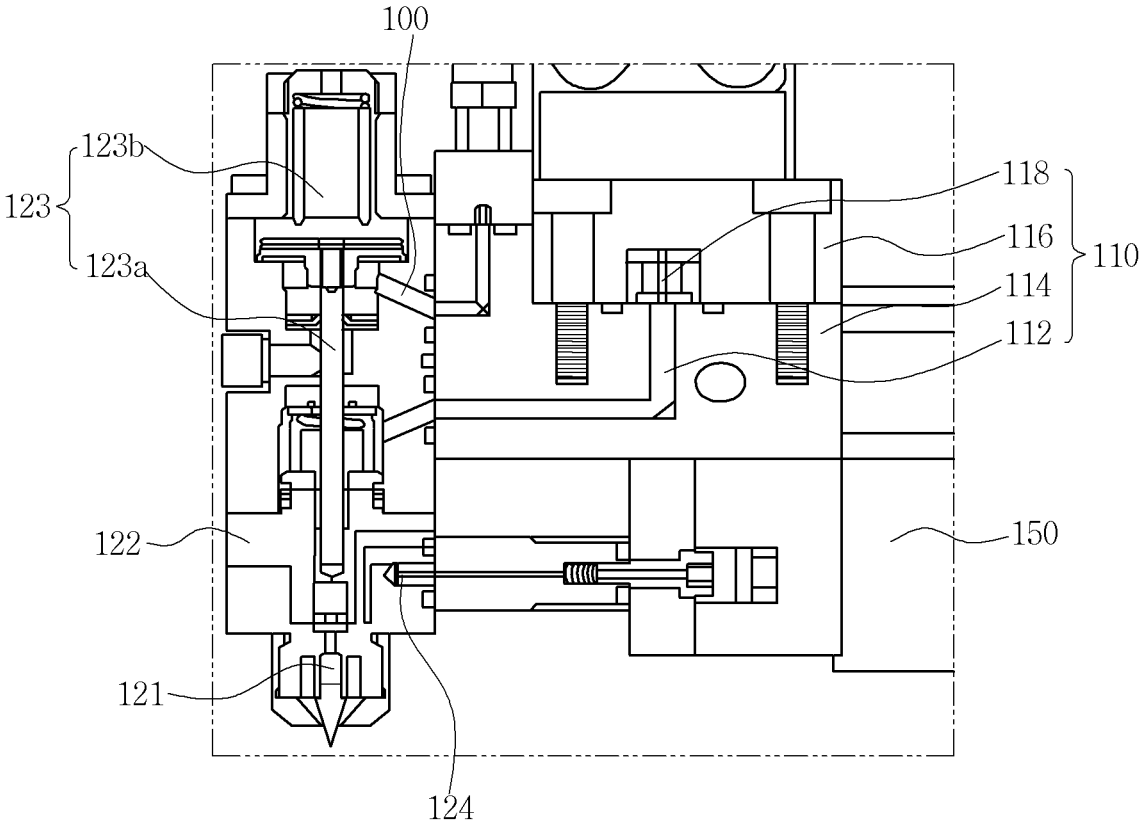
FIG. 7 is a longitudinal sectional view showing the structure of an electro-spinning apparatus according to an embodiment of the present invention.

To this end, in this embodiment, the solution distribution unit 110 may be specifically configured to include a lower distribution plate 114, a top cover plate 116, and an intermediate distribution plate 118 as shown in FIGS. 3 and 7. First, as shown in FIGS. 1 and 3, the lower distribution plate 114 is formed in a long plate shape overall and has a plurality of injection lines 112 formed at regular intervals, and each of the injection lines 112 is formed to pass through the lower distribution plate 114 in the vertical and horizontal directions. At this point, a spinning nozzle 120 is coupled to each injection line 112.

Next, the top cover plate 116 is a component installed to be coupled on the top surface of the lower distribution plate 114 as shown in FIGS. 3 and 7 to form a predetermined enclosed space while being coupled to the lower distribution plate 114. That is, the top cover plate 116 is engraved from the bottom to the top to form a distribution groove on the bottom, and the intermediate distribution plate 118 is inserted into the distribution groove.

In addition, the distribution groove is formed to have a width enough to cover all the plurality of injection lines 112 while being coupled to the lower distribution plate 114 and forms an enclosed space.

Figure 4:
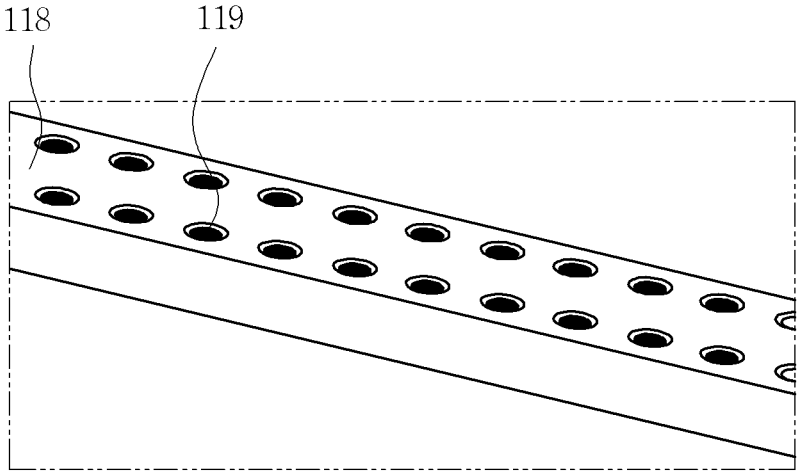
FIG. 4 is a partially perspective view showing the structure of an intermediate distribution plate according to an embodiment of the present invention.
Figure 5:
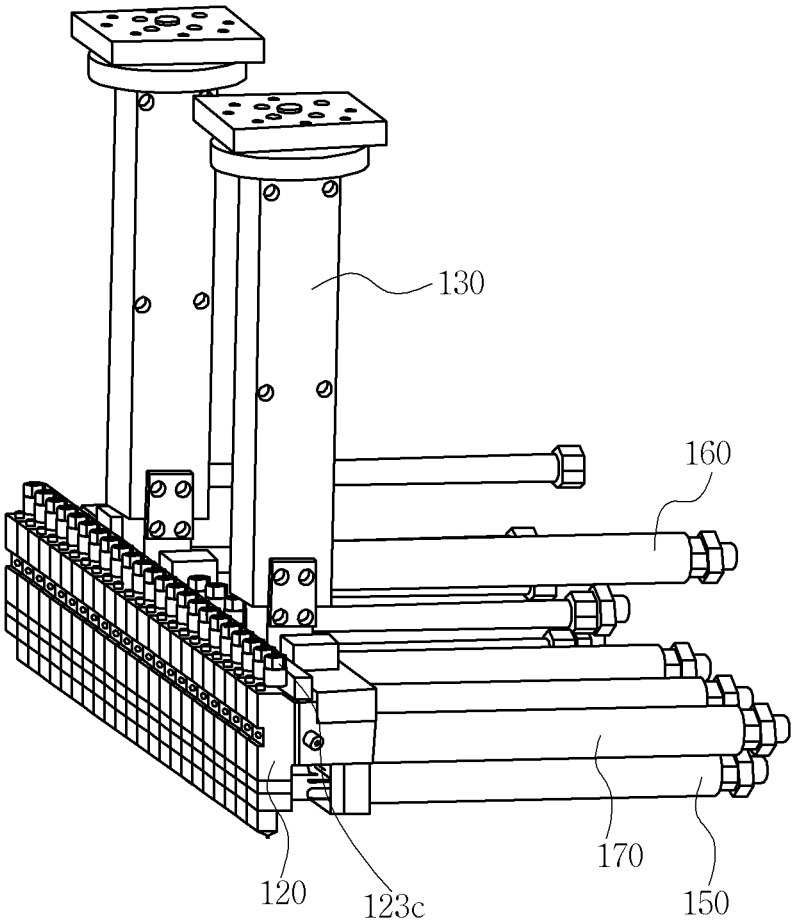
FIG. 5 is a perspective view showing the structure of an electro-spinning apparatus from still another different angle according to an embodiment of the present invention.

Next, the intermediate distribution plate 118 is a component installed to be interposed in the enclosed space as shown in FIGS. 3 and 4 to uniformly distribute and move the spinning solution supplied to the enclosed space toward the injection line 112. That is, the intermediate distribution plate 118 is formed in a long plate shape overall, and a plurality of distribution holes 119 is uniformly arranged across the entire area to pass through the plate as shown in FIG. 4.

Accordingly, the spinning solution supplied to the distribution groove by the solution supply line 130 passes through the plurality of distribution holes 119 and moves toward the bottom, and the spinning solution is uniformly distributed to the plurality of injection lines 112 in the process.

Next, a plurality of spinning nozzles 120 is installed to be individually coupled on the front side of the solution distribution unit 110 as shown in FIG. 1. At this point, the plurality of spinning nozzles 120 is installed to be individually coupled to the plurality of injection lines 112 and spins while adjusting the spinning amount of the spinning solution supplied through the injection lines 112.

That is, in this embodiment, the plurality of spinning nozzles 120 has a structure individually detachable from the solution distribution unit 110, and each of the spinning nozzles 120 has a structure capable of independently adjusting a spinning amount. Accordingly, a sample test is conducted on the spun fiber, and if the spinning amount in a specific section is non-uniform compared with those of the other sections, a uniform spinning result may be obtained by individually controlling the spinning amounts of the spinning nozzles 120 which inject the spinning solution in corresponding sections.

To this end, in this embodiment, the spinning nozzle 120 may be specifically configured to include a spinning hole 121, a nozzle body 122, a spinning adjustment valve 123, and a hot air injection hole 124 as shown in FIG. 7. First, the nozzle body 122 is a component detachably coupled on the side surface of the lower distribution plate 114 and configuring the overall appearance of the spinning nozzle 120 according to this embodiment. The nozzle body 122 is also preferably made of an electrical conductor like the solution distribution unit 110.

In addition, the spinning hole 121 for spinning the spinning solution toward the bottom is formed in the nozzle body 122 as shown in FIG. 7.

Next, the spinning adjustment valve 123 is a component installed on the top of the nozzle body 122 as shown in FIGS. 1 and 7 to adjust the amount of the spinning solution spun through the spinning hole 121, in a method of adjusting the opening degree of the spinning hole 121. The spinning adjustment valve 123 may be specifically configured to include a valve rod 123*a*, an elastic unit 123*b*, and an adjustment knob 123*c*. The valve rod 123*a* is a component installed to pass through the nozzle body 122 in the vertical direction as shown in FIG. 7, the lower end of which is inserted into the upper end of the spinning hole 121. In addition, the elastic unit 123*b* is a component for pressing the valve rod 123*a* toward the top using an elastic force, and the adjustment knob 123*c* is a component installed on the top of the nozzle body 122 to finely move the valve rod 123*a* in the vertical direction by rotating the valve rod 123*a*.

Next, the hot air injection hole 124 is a component installed on the bottom of the nozzle body 122 as shown in FIG. 7 to guide hot air supplied by the hot air supply unit 150 to the spinning hole 121 and inject the hot air toward the bottom together with the spinning solution. Accordingly, the spinning solution spun from the spinning nozzle 120 according to this embodiment may maintain a state heated to a predetermined temperature until the spinning solution is spun, by the hot air injection hole 124.

In addition, it is preferable in this embodiment to further provide a solution control unit 125 in the nozzle body 122 as shown in FIG. 7 to control the spinning solution supplied to the spinning hole 121. Since it needs to block supply itself of the spinning solution to the individual nozzle body 122 when the spinning operation is stopped or when a replacement or maintenance work is needed for each nozzle valve 120, the solution control unit 125 controls supply itself of the spinning solution to the spinning nozzle 120.

Next, the solution supply line 130 is a component installed to be coupled on the top of the solution distribution unit 110 as shown in FIG. 1 to supply the spinning solution heated to a high temperature to the solution distribution unit 110. That is, the solution supply line 130 is supplied with the spinning solution from a spinning solution supply unit (not shown) installed at an upper position to supply the spinning solution, which is heated to a predetermined temperature, at a predetermined pressure and supply the spinning solution to the solution distribution unit 110 installed at a lower position. At this point, since the spinning solution should not be cooled down and maintain a predetermined temperature while passing through the solution supply line 130, a line heating unit 160 is provided in the solution supply line 130.

Meanwhile, since the solution distribution unit 110 is made of an electrical conductor overall and supplied with high voltage as described above, the solution supply line 130 is preferably made of an insulator overall to block the high voltage supplied to the solution distribution unit 110 so as not to be transferred to the upper side.

Figure 6:
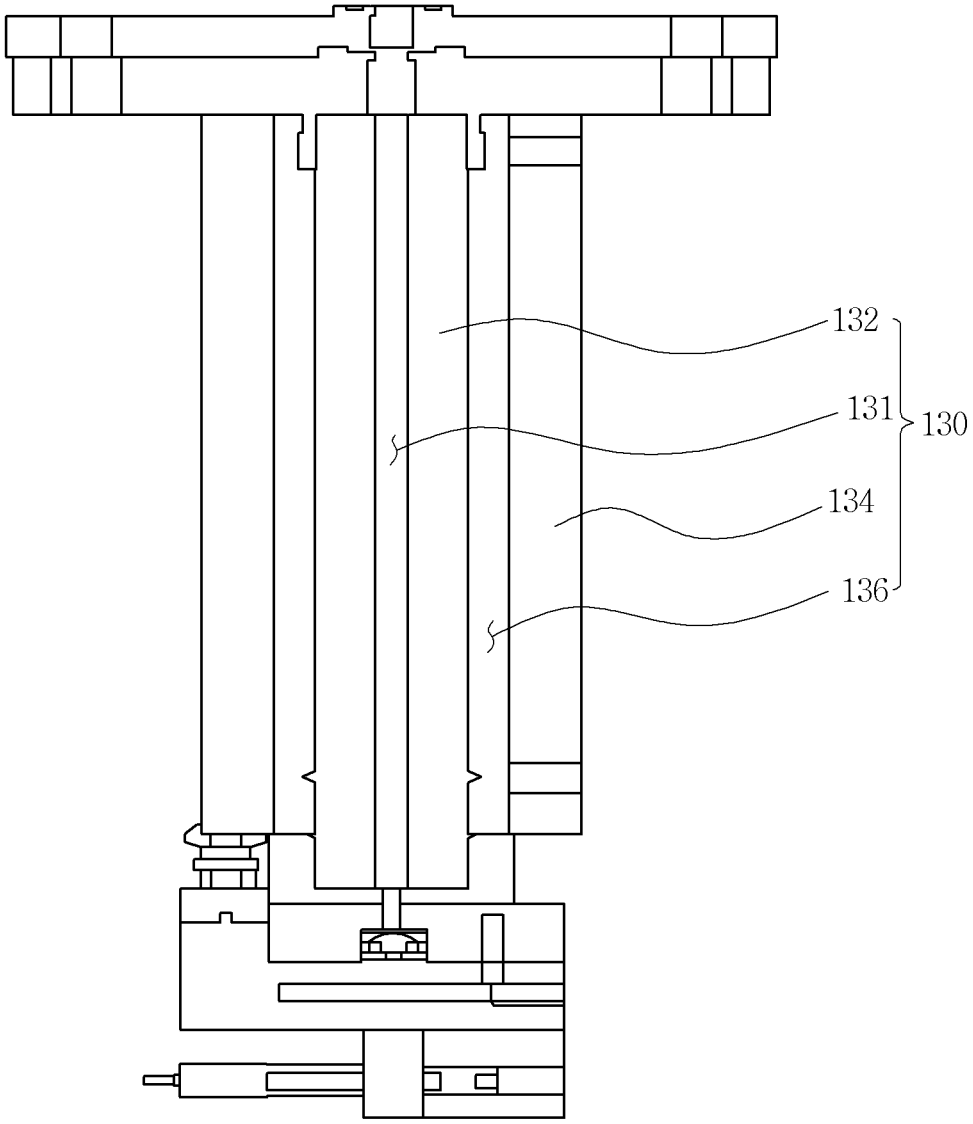
FIG. 6 is a cross-sectional view showing the structure of a solution supply line according to a first embodiment of the present invention.

Accordingly, as shown in FIG. 6, the solution supply line 130 is configured of a ceramic pipe 132 having a solution passing hole 131 formed therein and an outer cover member 134 for wrapping the ceramic pipe 132 from the outside, and a hot air passing hole 136 for passing the hot air supplied by the line heating unit 160 is formed between the ceramic pipe 132 and the outer cover member 134. As the hot air moves from the bottom to the top through the hot air passing hole 136, the ceramic pipe 132 inside thereof is heated.

Figure 2:
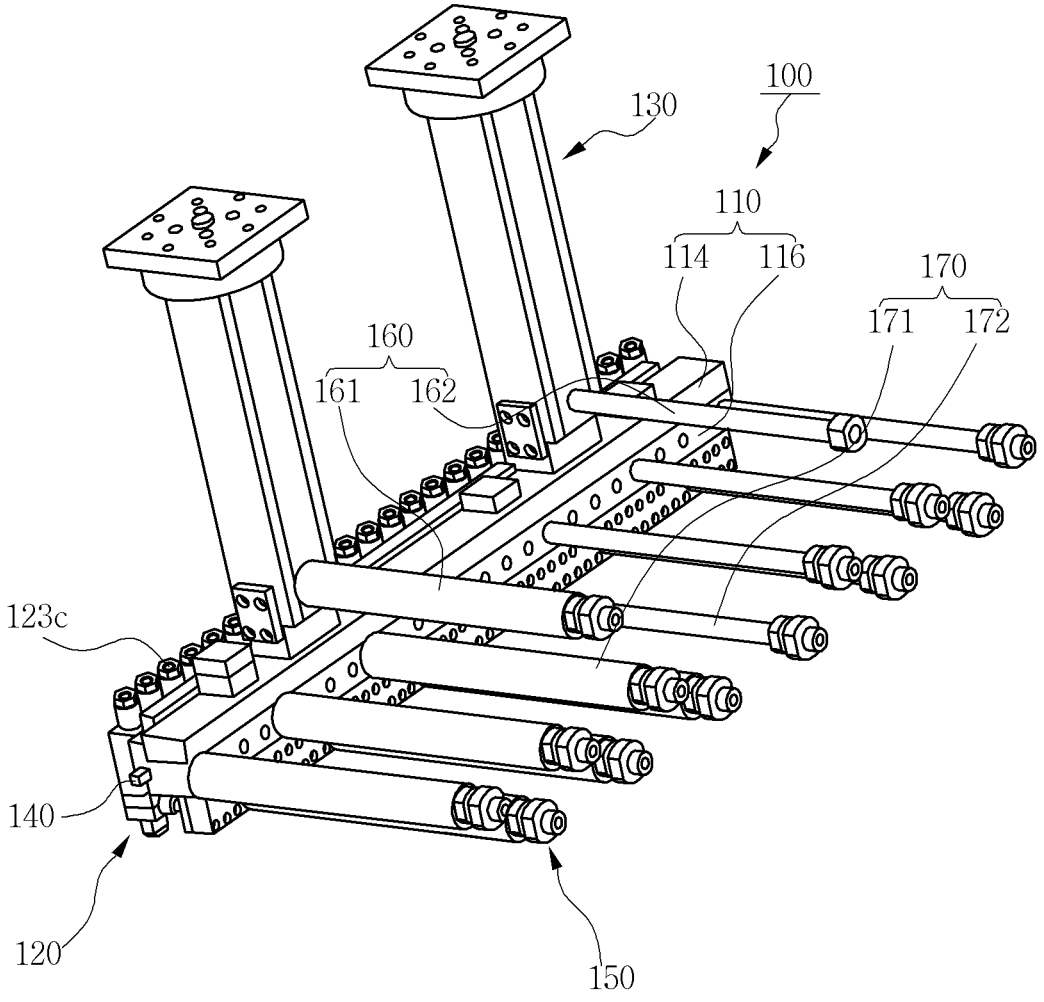
FIG. 2 is a perspective view showing the structure of an electro-spinning apparatus from another angle according to an embodiment of the present invention.

Meanwhile, the line heating unit 160 may be specifically configured to include an insulation pipe 161, a heating rod 162 and an air supply unit as shown in FIG. 2. The insulation pipe 161 is a component an end of which is coupled to the solution supply line 130 and having a penetration hole formed therein, and the heating rod 162 is a component installed to be inserted into the insulation pipe 161 and spaced apart from the inner side of the insulation pipe 161 to emit heat by the power supplied from the outside. In addition, the air supply unit (not shown) supplies air into the space formed between the heating rod 162 and the insulation pipe 161. The solution supply line 130 is heated as the air continuously supplied by the air supply unit is quickly heated while passing through around the heating rod 162.

Next, the high voltage supply unit 140 is a component installed on one side of the solution distribution unit 110 as shown in FIGS. 1 and 2 to supply high voltage power. If high voltage is supplied to the solution distribution unit 110 and a plurality of spinning nozzles 120 by the high voltage supply unit 140, an electric field is formed between a conveyor (not shown) installed on the lower side and grounded, and a fiber of a fine diameter spun by the spinning nozzle 120 is made as a nano-fiber by the electrical field.

Next, the hot air supply unit 150 is a component for supplying air of hot temperature to each of the plurality of spinning nozzles 120 and injecting the hot air through the spinning nozzle 120 together with the spinning solution. The hot air supplied by the hot air supply unit 150 like this is guided to the spinning hole 121 through the hot air injection hole 124 and spun together with the spinning solution as described above.

Meanwhile, the solution distribution unit 110 preferably further includes a distribution unit heating unit 170 for heating the solution distribution unit 110 as shown in FIG. 2. Since the spinning solution should not be cooled down while passing through the solution distribution unit 170, the distribution unit heating unit 170 heats up the solution distribution unit 110 to a predetermined temperature in a manner the same as that of heating the solution supply line 130.

At this point, the distribution unit heating unit 170 preferably has a configuration practically the same as that of the line heating unit 160 for easy installation and maintenance.

According to the electro-spinning apparatus of the present invention, since the spinning solution maintains a predetermined temperature throughout the entire process including supply, distribution and spinning of the spinning solution, uniformity of spinning can be secured, and there is an advantage in that uniform spinning can be performed with respect to the entire width of a manufactured fiber as the spinning nozzles are individually controlled, and maintenance is easy to perform.

What is claimed is:

1. An electro-spinning apparatus comprising:

a solution distribution unit including a plurality of injection lines and made of an electrical conductor, the solution distribution unit being configured to supply a spinning solution through each of the injection lines;

a spinning nozzle detachably coupled to the each of the injection lines and made of an electrical conductor, wherein the spinning nozzle comprises: a nozzle body configured to detachably attached to the solution distribution unit; a spinning hole formed in the nozzle body and coupled to the each of the injection lines; and a spinning adjustment valve, thereby the spinning nozzle being able to individually and independently perform spinning of the spinning solution supplied through the each of the injection lines and individually and independently control a spinning amount of the spinning solution supplied through the each of the injection lines;

a solution supply line configured to supply the spinning solution to the solution distribution unit;

a high voltage supply unit configured to supply high voltage power to the solution distribution unit;

a hot air supply unit configured to supply hot-air to the spinning nozzle for injecting the hot air through the spinning nozzles together with the spinning solution, wherein the solution distribution unit includes:

a lower distribution plate where each of the injection lines are formed at regular intervals;

a top cover plate installed on top of the lower distribution plate and having a groove formed on a bottom of the top cover plate to form a predetermined enclosed space with the lower distribution plate; and an intermediate distribution plate installed inside the predetermined enclosed space to uniformly distribute and move the spinning solution supplied to the predetermined enclosed space toward each of the injection lines.

2. The apparatus according to claim 1, wherein the intermediate distribution plate comprises: a plurality of distribution holes to uniformly distribute the spinning solution to each of the injection lines.

3. The apparatus according to claim 1, wherein the solution supply line comprises: a line heating unit to heat the spinning solution to a predetermined temperature.

4. The apparatus according to claim 1, wherein the solution distribution unit further comprises: a distribution unit heating unit to heat the solution distribution unit to a predetermined temperature.

5. The apparatus according to claim 1, wherein the nozzle further comprises: a hot air injection hole through which the hot air is supplied to the spinning hole.

* * * * *